US005861607A

United States Patent [19]

Jarrett

[11] Patent Number: 5,861,607

[45] Date of Patent: Jan. 19, 1999

[54] BRAID SINGEING CLAMP

[76] Inventor: Vera A. Jarrett, 1136 N. Viceroy Ave., Covina, Calif. 91722

[21] Appl. No.: 729,790

[22] Filed: Oct. 8, 1996

[51] Int. Cl.[6] ..... A45G 1/00

[52] U.S. Cl. ..... 219/225; 219/227; 219/231; 132/224

[58] Field of Search ..... 219/225, 222, 219/223, 227–231; 132/224, 225, 229, 269

[56] References Cited

U.S. PATENT DOCUMENTS

| | | | |
|---|---|---|---|
| 1,455,696 | 5/1923 | Wright | 219/225 |
| 1,719,232 | 7/1929 | Meade | 219/225 |
| 1,800,271 | 4/1931 | Wehner | 219/225 |
| 1,847,479 | 3/1932 | Godefroy | 219/225 |
| 2,400,696 | 5/1946 | Jones | 219/225 |
| 3,049,131 | 8/1962 | Leclabart | 132/225 |
| 3,173,429 | 3/1965 | Pauldine | 219/225 |
| 4,739,151 | 4/1988 | Smal | 219/225 |
| 4,982,748 | 1/1991 | Trimarchi | 132/201 |

FOREIGN PATENT DOCUMENTS

| | | | |
|---|---|---|---|
| 385513 | 12/1932 | United Kingdom | 219/225 |

*Primary Examiner*—John A. Jeffrey
*Attorney, Agent, or Firm*—Goldstein & Associates

[57] ABSTRACT

A braid singeing clamp for singeing the end of a braid to prevent said braid from coming undone. The braid singeing clamp comprises a pair of pivotally connected clamping surfaces having grips on one end and heating elements on the opposite end. The heating surfaces are attached to each clamping element by a set of rings which are situated on the top portion of each surface. The rings slide over a tube portion of each clamping element, and secure the heating surfaces to the clamp. Alternatively, the heating surfaces may snap into sockets positioned on the tube portion of each clamping element. The heating elements are shaped to envelope the lower portion of the braid and provide heat only to the braid end.

4 Claims, 3 Drawing Sheets

Fig. 3A
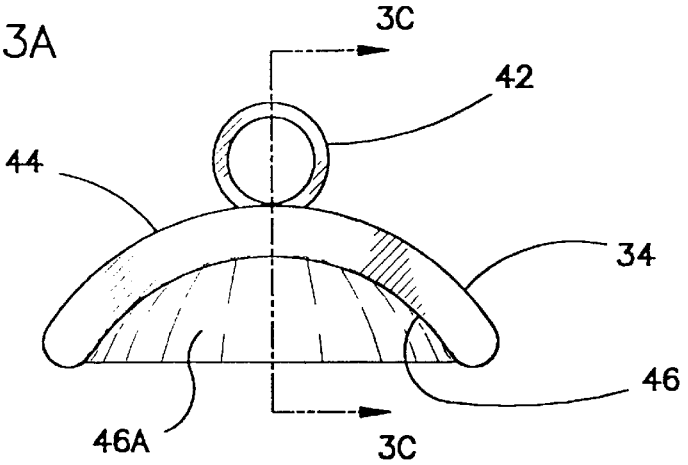
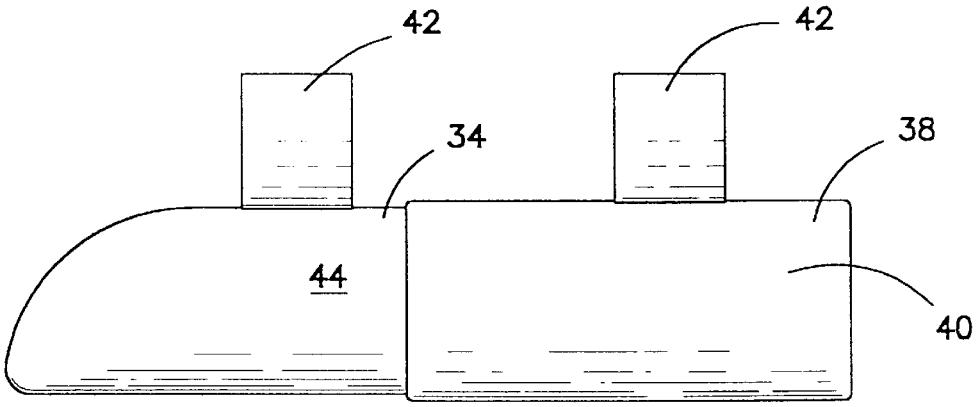
Fig. 3B
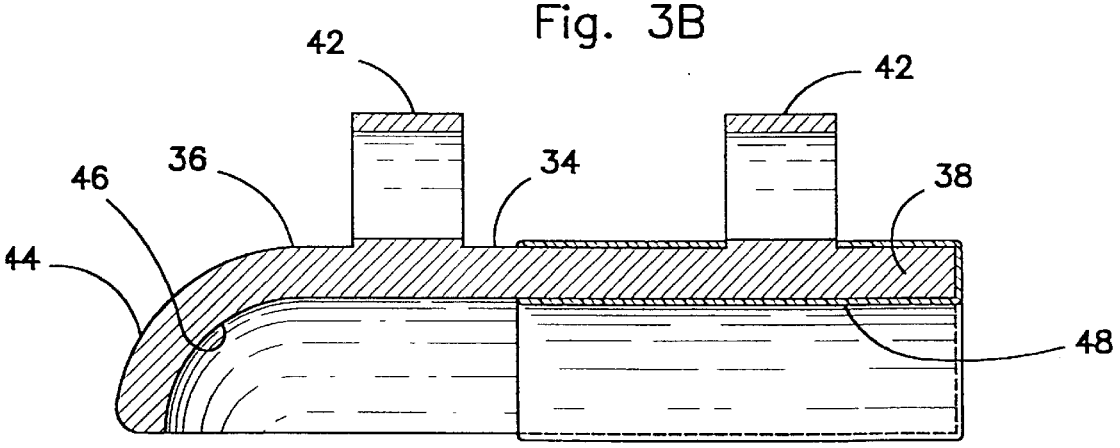
Fig. 3C

BRAID SINGEING CLAMP

BACKGROUND OF THE INVENTION

The invention relates to a braid singeing clamp. More particularly, the invention relates to a scissor shaped apparatus with a heating clamp on one end which grabs a braid or ponytail, and singes its end.

Men and women spend a great deal of time and effort making their hair fashionable and presentable. Hair can be arranged in many different ways: it can be curled, straightened, braided, beaded, and put in a ponytail. Hair styling has emerged in the 1990's as a true art form. The traditional ponytail hairstyle has also made a major comeback.

The conventional method of using a rubber band to prevent a braid from coming undone, however, is no longer in mode. The use of a rubber band, to prevent a braid from coming undone, is frowned upon by many beauticians because it disrupts the aesthetic quality of the flowing hair lines. Therefore, many beauticians currently use a match flame or a traditional heating clamp to singe the ends of the braid. However, the use of an open flame in a room where aerosol hair spray cans are constantly being sprayed is extremely dangerous. Furthermore, using a match flame to singe the braid end makes it extremely difficult to control the amount of heat applied to the braid end. A traditional heating clamp is also inappropriate for the task of singeing the end of a braid because it does not have a heating surface to apply heat directly to the end of a braid.

While these units may be suitable for the particular purpose employed, or for general use, they would not be as suitable for the purposes of the present invention as disclosed hereafter.

SUMMARY OF THE INVENTION

It is an object of the invention to produce a braid singeing clamp which singes the end of a braid preventing it from coming undone.

It is another object of the invention to produce an aesthetic means for holding a braid together.

It is a further object of the invention to produce a braid singeing clamp which has a plurality of different heat settings.

It is yet another object of the invention to produce a braid singeing clamp which applies heat only to the end of a braid.

It is a still further object of the invention to produce a braid singeing clamp with a plurality of different sized removable heating clamps which can accommodate braids of varying sizes.

The invention is a braid singeing clamp for singeing the end of a braid to prevent said braid from coming undone. The braid singeing clamp comprises a pair of pivotally connected clamping elements having grips on one end and heating surfaces on the opposite end. The heating elements are shaped to envelope the lower portion of the braid and provide heat only to the braid end.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 3A is a front elevation view of the sliding heating surface.

FIG. 3B is side elevation view of the sliding heating surface.

FIG. 3C is cross section of the sliding heating surface taken along line 3C—3C.

DETAILED DESCRIPTION OF THE PREFERRED EMBODIMENTS

Figure 1:
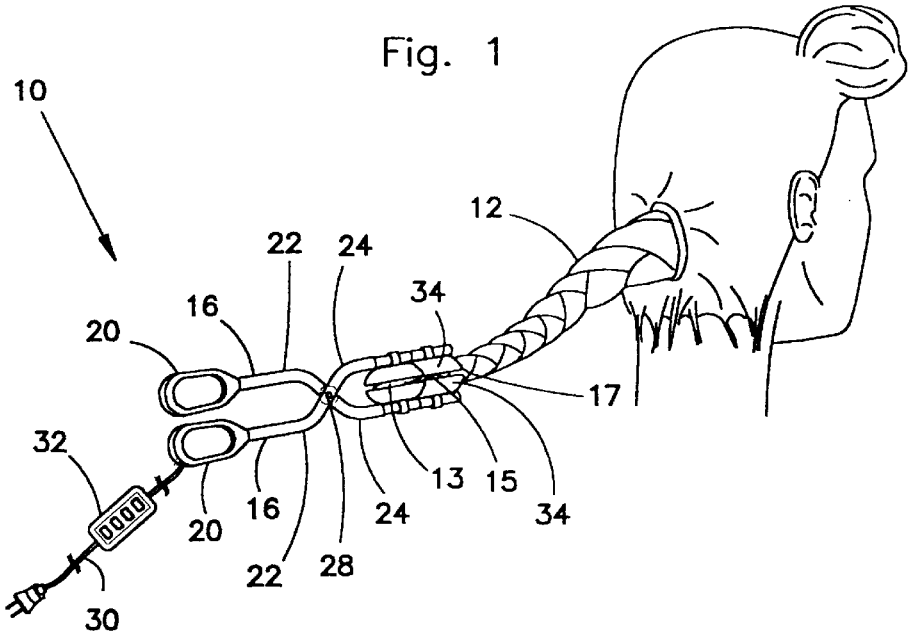
FIG. 1 is a perspective view of the braid singeing clamp clamped to the lower portion of a braid.

FIG. 1 illustrates a braid singeing clamp 10 clamped onto a ponytail 12. The ponytail has a lower portion 15, a top lower portion 17, and an end 13. The term "ponytail" and "braid" are used interchangeably herein. The ponytail singeing clamp 10 comprises a pair of clamping elements 16 having a pair of grip portions 20, a pair of proximal tube portions 22, a pair of distal tube portions 24, a pair of sliding heating surfaces 34 attached to the distal tube portions 24, and a power cord 30. The clamping elements 16 are pivotally connected at a pivot point 28. One of the sliding heating surfaces 34 is secured to the distal tube portion 24 of each clamping element 16. The power cord 30 projects from one of the grip portions 20 and has a heat control panel 32 connected to it.

After the ponytail or braid is completed, the lower portion 15 of the ponytail 12 is clamped in between the sliding heating surfaces 34 by forcing the grip portions 20 towards each other.

Figure 2:
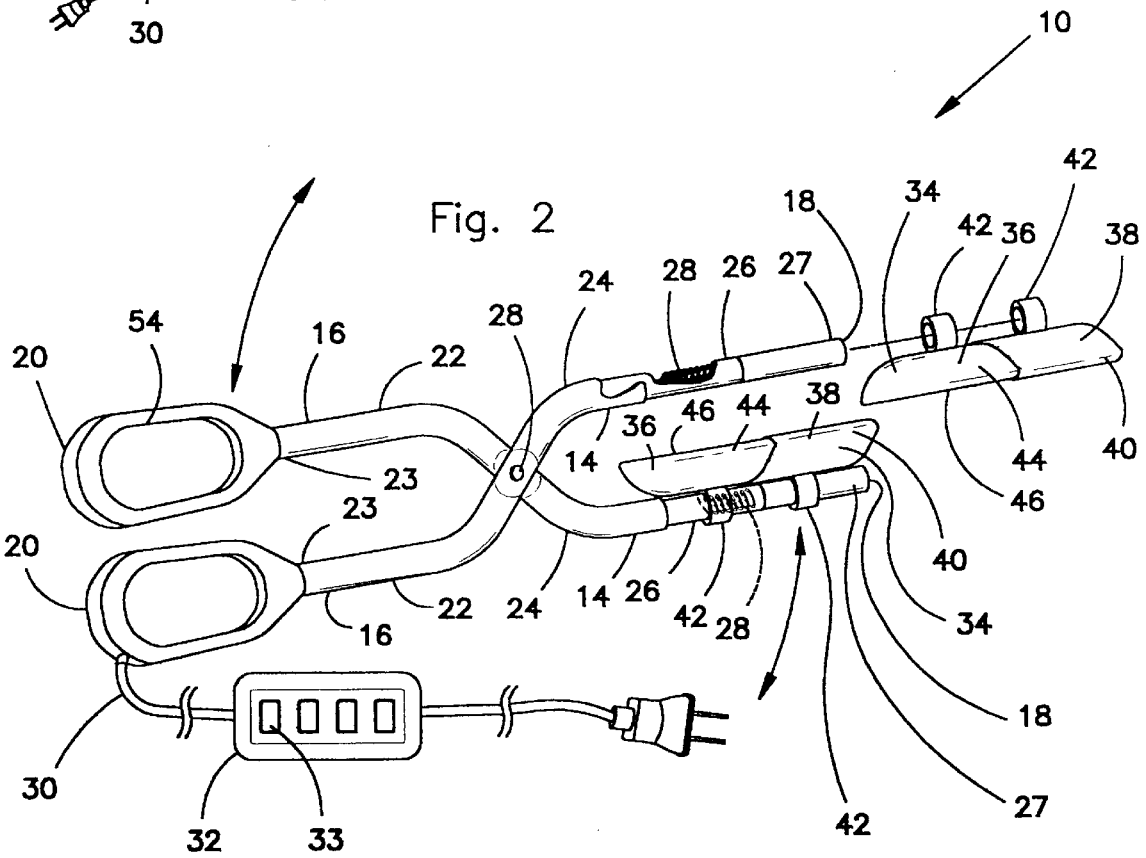
FIG. 2 is a perspective view of the braid singeing clamp with one sliding heating surface temporarily removed.

FIG. 2 illustrates the braid singeing clamp 10 with one of the sliding heating surfaces 34 removed. Each grip portion 20 has a finger opening for allowing one or more fingers to extend therethrough to hold the grips. The sliding heating surfaces 34 may be made so that when brought together they form differing diameter openings, for accommodating braids and ponytails of different sizes.

The proximal tube portion 22 of each clamping element 16 has a first end 23. The distal tube portion 24 of each clamping element 16 has a second end 27 and a heating area 26 located between the second end 27 and the pivot point 28. A bore 18 extends from the second end 27 of each distal tube portion 24 through the first end 23 of each proximal tube portion 22. A heating coil 28 is located in the bore 18 in the heating area 26 of the distal tube portion 24 of each clamping element 16. The proximal tube portion 22 and the distal tube portion 24, except for the heating area 26, of each clamping element 16 has a first insulating coating 14 applied to it. Suitable manners for transmitting power from the power cord 30 to each of the heating coils 28 is well known.

Each sliding heating surface 34 has a pair of rings 42, an inner surface 46, an outer surface 44, a pair of rings 42 secured to the outer surface 44, an insulated portion 38 and a conductive portion 36. The insulated portion 38 of each sliding heating surface 34 has a second insulating coating 40 applied to it. The rings 42 project from the outer surface 44 of each sliding heating surface 34. The rings 42 are parallel and are spaced a predetermined distance from each other.

One sliding heating surface 34 is secured to each distal tube portion 24 by sliding the rings 42 of the sliding heating surface 34 over the distal tube portion such that the conductive portion 36 of the sliding heating surface 34 is nearly in contact with the heating area 26 of the distal tube portion 24. The sliding heating surfaces 34 transfer the heat produced by the heating coil 28 to the lower portion 15 of the ponytail 12. The heat control panel 32 has four push buttons 33 which can be manually depressed by a user to control the level of heat delivered to the heating coil 28, or to switch the heat off.

FIG. 3A is a front elevation view of one of the sliding heating surfaces 34. The inner surface 46 has a concave shape for receiving the end of the ponytail 12. The ring 42 can be seen again to be secured to the outer surface 44 of the sliding heating surfaces 34. The inner surface 46 includes a terminal surface 46A, which is a semi-sphere. In use, the end of the ponytail 12 actually contacts the terminal surface. Thus, the terminal surface 46A actual singes the hair, and is the only portion of the inner surface 46 which must be heat conducting.

FIG. 3B is a side elevation view of one of the sliding heating surfaces 34. The insulated portion 38 of the sliding heating surfaces 34 can be seen again to have a second insulating coating 40 on its outer surface 44. The rings 42 can also be seen to be concentric, to allow the distal tube portion 24 to slide therethrough.

FIG. 3C illustrates a cross section of the sliding heating surfaces 34 taken along line 3C—3C. The inner surface 46 of the insulated portion 38 of the sliding heating surfaces 34 has a third insulating coating 48 which prevents the top lower portion 17 of the ponytail 12 from being singed. The terminal surface 46A of the inner surface 46 of the conductive portion 36 of each of the sliding heating surfaces 34 can be seen to be concave in shape for receiving the end 13 of the ponytail 12. The terminal surface 46A is not insulated by the third insulating coating 48.

Figure 4:
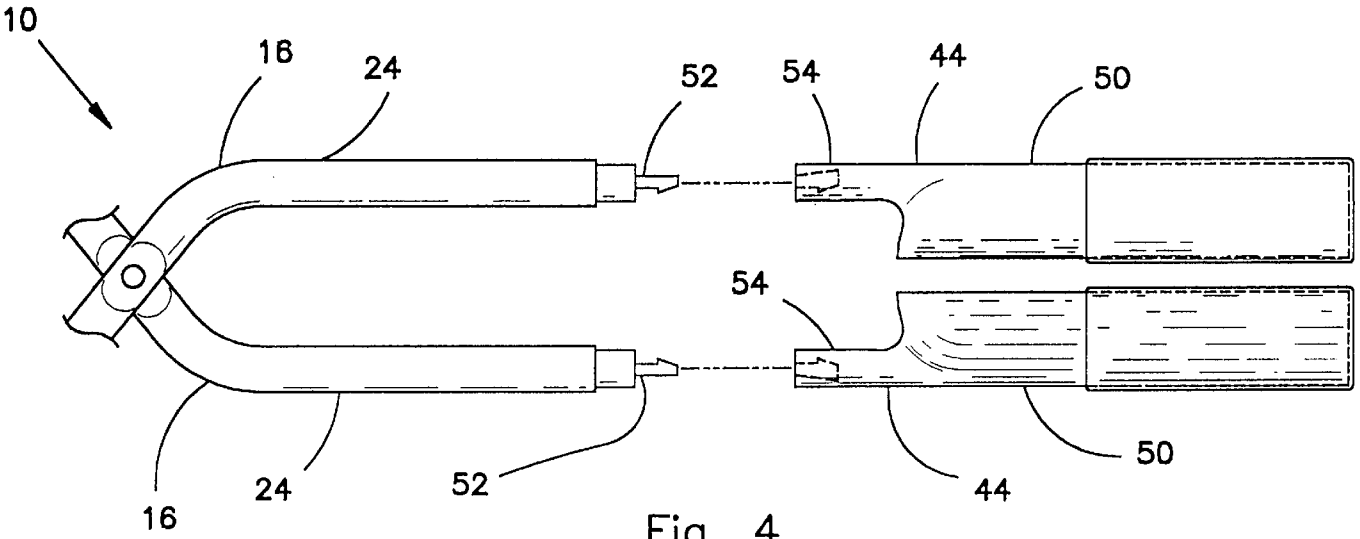
FIG. 4 is perspective view of the right hand portion of the braid singeing clamp with snap on heating surfaces.

FIG. 4 illustrates an alternate embodiment of the braid singeing clamp 10 with snap on heating surfaces 50 instead of the sliding heating surfaces 34. Each distal tube portion 24 has a distal tube portion plug 52. The snap on heating elements 50 are similar to the sliding heating surfaces 34 except that each snap on heating surface 50 has a socket portion 54 and does not have rings 42 secured to its outer surface 44. The snap on heating surfaces 50 can be easily attached to and removed from the distal tube portion plug 24 of the clamping elements 16.

Figure 5B:
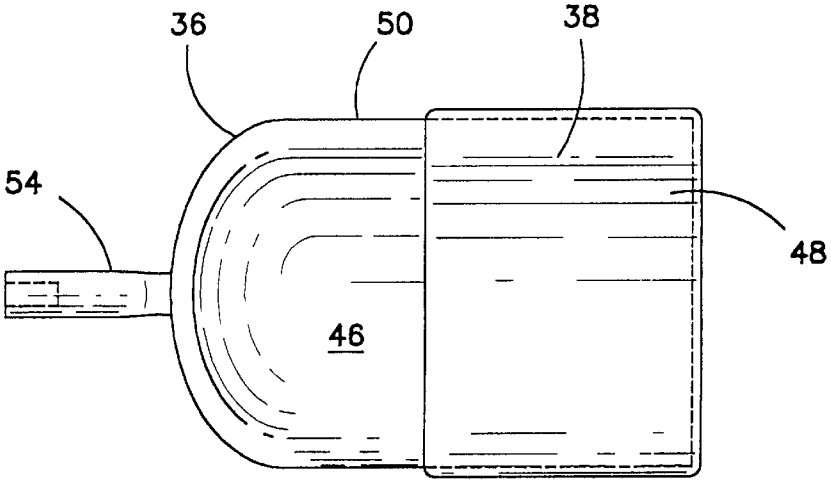
FIG. 5B is a plan view of the underside of the snap on heating surface.
Figure 5A:
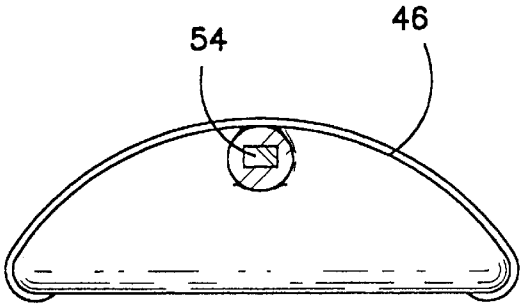
FIG. 5A is a rear elevation view of the snap on heating surface.

FIG. 5A is a rear elevation view of the snap on heating element 50. The snap on heating surface 50 can be seen again to have the socket portion 54 which mates with the distal tube portion plug 52.

FIG. 5B is a plan view of the underside of the snap on heating surface 50. The socket portion 54 projects from the conductive portion 36 of the snap on heating surface 50. The inner surface 46 of the snap on heating surface 50 has a concave shape for receiving the lower portion 15 of the ponytail 12. The insulated portion 38 of the snap on heating surface 50 is coated with the third insulating coating 48 which prevents the top lower portion 17 of the ponytail 12 from being singed.

In conclusion, herein is presented a device for singeing the ends of braid, ponytail, or the like, without the necessity for a match, lighter, or other open flame.

What is claimed is:

1. A braid singeing clamp comprising:

a pair of clamping elements each having a proximal tube portion and a distal tube portion, the clamping elements are pivotally connected at a pivot point located between said distal tube portion and said proximal tube portion;

a pair of grip portions for facilitating the process of forcing the proximal tube portion of each clamping element towards one another, one of the grip portions secured to the proximal tube portion of each clamping element;

a pair of heating surfaces, one heating surface secured to the distal tube portion of each clamping element for singeing an end of a ponytail;

a heating means for heating the heating surface comprising a heating coil located in an electric heating area in the distal tube portion of each clamping element; and an insulating coating cover extending the length of each clamping element, except for the heating area.

2. The braid singeing clamp of claim 1 wherein the heating means further comprises a heat control panel adapted to be manually operated by a user to control the amount of heat produced by the heating coil.

3. The braid singeing clamp as in claim 2 wherein each heating surface has an inner surface, an outer surface, a pair of rings, a conductive portion, and a insulated portion, the inner surface of the heating surface has a concave shape for receiving one half of the end of the ponytail, said insulated portion having an insulating coating to prevent singeing of any other portion of the braid besides the end, the pair of rings secured to and projecting from the outer surface of the heating surface, the pair of rings parallel to each other and spaced a predetermined distance apart, said rings adapted to slide onto the distal tube portion such that the conductive portion of the heating surface is nearly in contact with the heating coil and in heat transfer relation therewith.

4. The braid singeing clamp as recited in claim 1, wherein each clamping element an inner surface having a terminal surface, the inner surface having an insulating layer which does not cover the terminal surface.

* * * * *